US006513653B1

(12) United States Patent
Chen

(10) Patent No.: US 6,513,653 B1
(45) Date of Patent: Feb. 4, 2003

(54) HEAD FRAME FOR A GOLF BAG

(76) Inventor: Changfu Chen, P.O. Box 63-247, Taichung (TW)

( * ) Notice: Subject to any disclaimer, the term of this patent is extended or adjusted under 35 U.S.C. 154(b) by 0 days.

(21) Appl. No.: 09/595,233

(22) Filed: Jun. 16, 2000

(51) Int. Cl.[7] ..... A63B 55/00
(52) U.S. Cl. ..... 206/315.7; 248/96; D3/255
(58) Field of Search ..... 206/315.3, 315.6, 206/315.7; 248/96; D3/255

(56) References Cited

U.S. PATENT DOCUMENTS 1,404,559 A * 1/1922 Watrous ..... 206/315.7
1,555,019 A * 9/1925 MacDonald ..... 206/315.3
1,769,011 A * 7/1930 Bickford ..... 248/96
2,064,542 A * 12/1936 Jones ..... 206/315.7
2,148,947 A * 2/1939 Jackson ..... 248/96
2,482,372 A * 9/1949 Rossow ..... 206/315.2
5,236,085 A * 8/1993 Quellais ..... 206/315.7
5,673,879 A * 10/1997 Hsieh ..... 206/315.7
6,062,383 A * 5/2000 Han ..... 206/315.3
6,227,503 B1 * 5/2001 Chen ..... 206/315.7 X
6,241,201 B1 * 6/2001 Wang ..... 206/315.7
6,241,202 B1 * 6/2001 Chen ..... 206/315.7 X
6,299,112 B1 * 10/2001 Suk ..... 206/315.7

* cited by examiner

*Primary Examiner*—Stephen K. Cronin
(74) *Attorney, Agent, or Firm*—Alan Kamrath; Rider, Bennett, Egan & Arundel, LLP

(57) ABSTRACT

A golf bag includes a bag, a head frame mounted to an end of the bag, the head frame comprising two pivotal seats integrally formed thereon, and two supporting rods each having an upper end pivotally connected to an associated pivotal seat. The head frame includes a board integrally formed thereon and extended downward therefrom. Each pivotal seat includes a block integrally formed on the head frame, a stop integrally formed on the block, and a pivotal section integrally formed on the stop, the block defining a space between the head frame and the stop.

19 Claims, 7 Drawing Sheets

HEAD FRAME FOR A GOLF BAG

BACKGROUND OF THE INVENTION

1. Field of the Invention

The present invention relates to a head frame for a golf bag that may improve the assembly efficiency of golf bags.

2. Description of the Related Art

FIG. 1 of the drawings illustrates a conventional golf bag 80 including a bag 83, a mounting plate 81 attached to the rear of the bag 83, and two supporting rods 82 each having an upper end pivotally mounted to the mounting plate 81. The mounting plate 81 is attached to the bag 83 by riveting (see rivets 84) after formation of the main body of the golf bag 80. More specifically, the bag 83, generally made of cloth, is mounted around a main frame (not shown) for subsequent riveting of the mounting plate 81 to the bag 83, which is troublesome and time-consuming.

In addition, after the bag 83 is mounted around the main frame, a special machine is required for the riveting procedure. This takes a long time handling the bag 83 (which is generally ~80 cm to 90 cm in height and 25 cm to 30 cm in width) and the main frame having considerable volumes and weights. Further, control of the riveting positions is not easy, and this shall adversely affect the supporting function of the supporting rods 82. In some cases, the supporting rods 82 cannot provide their required supporting function if the riveting positions are not properly located.

SUMMARY OF THE INVENTION

It is the primary object of the present invention to provide a head frame for a golf bag that may improve the assembly efficiency of golf bags.

It is the secondary object of the present invention to provide a head frame for a golf bag that does not require positioning of the pivotal seat to which upper ends of the supporting rods are pivotally mounted.

In accordance with the present invention, a head frame for a golf bag comprises at least one pivotal seat integrally formed thereon. The pivotal seat is adapted to be in pivotal connection with an upper end of a supporting rod.

The head frame includes a board integrally formed thereon and extended downward therefrom. The pivotal seat includes a block integrally formed on the head frame, a stop integrally formed on the block, and a pivotal section integrally formed on the stop, the block defining a space between the head frame and the stop.

In an alternative embodiment of the invention, the pivotal seat includes a peg on each of two sides thereof. The head frame and the pivotal seat have at least one block integrally formed therebetween to thereby define a space between the head frame and the pivotal seat.

In an embodiment of the present invention, a golf bag comprises a bag, a head frame mounted to an end of the bag, the head frame comprising two pivotal seats integrally formed thereon, and two supporting rods each having an upper end pivotally connected to an associated pivotal seat. The head frame includes a board integrally formed thereon and extended downward therefrom. Each pivotal seat includes a block integrally formed on the head frame, a stop integrally formed on the block, and a pivotal section integrally formed on the stop, the block defining a space between the head frame and the stop.

In another embodiment of the invention, a golf bag comprises a bag, a head frame mounted to an end of the bag, the head frame comprising a pivotal seat integrally formed thereon, the pivotal seat including a peg formed on each of two sides thereof, and two supporting rods each having an upper end pivotally connected to an associated peg. The head frame and the pivotal seat have at least one block integrally formed therebetween to thereby define a space between the head frame and the pivotal seat.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
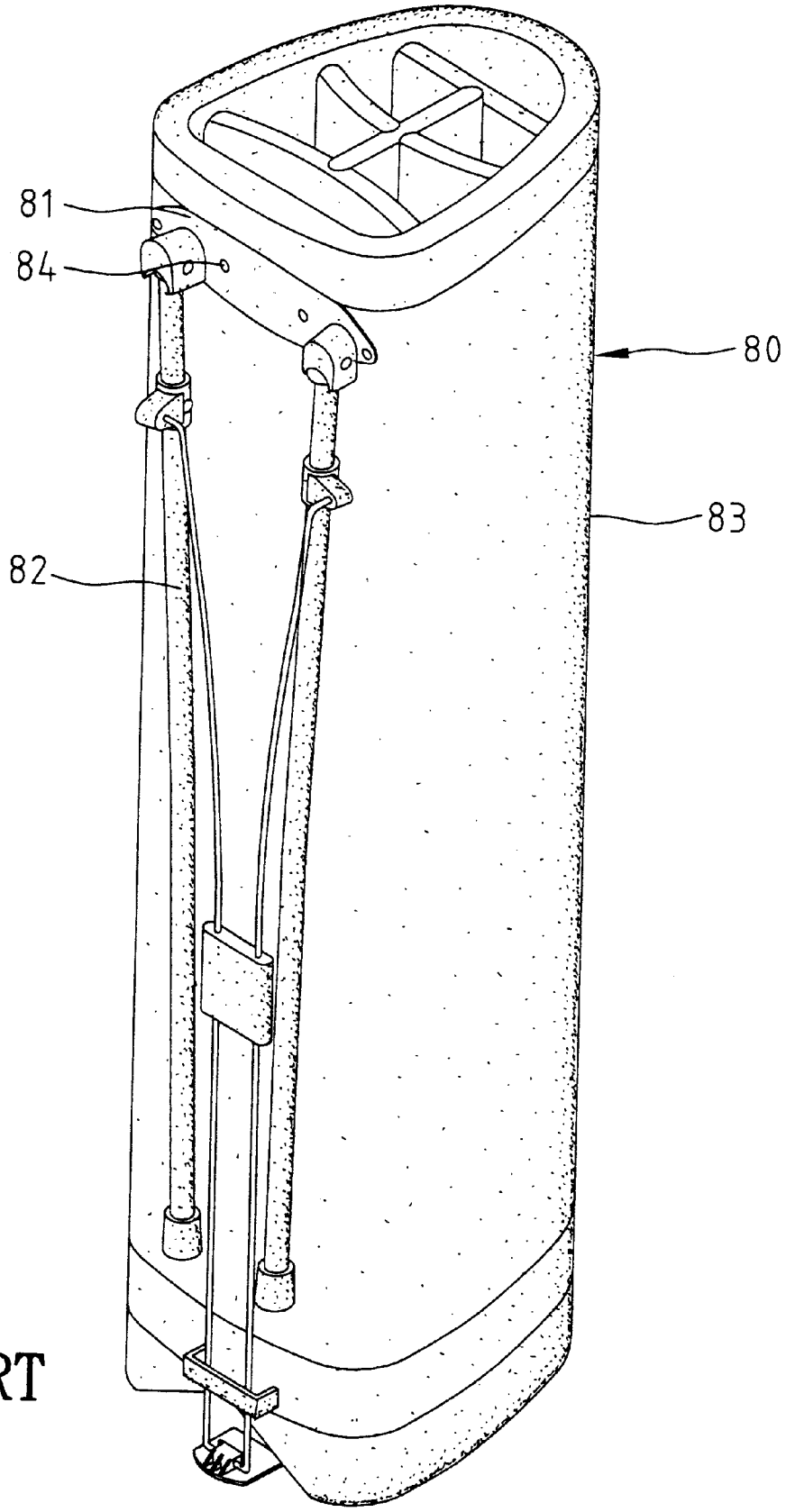
Fig. 1 PRIOR ART
FIG. 1 is a perspective view of a conventional golf bag.
Figure 2:
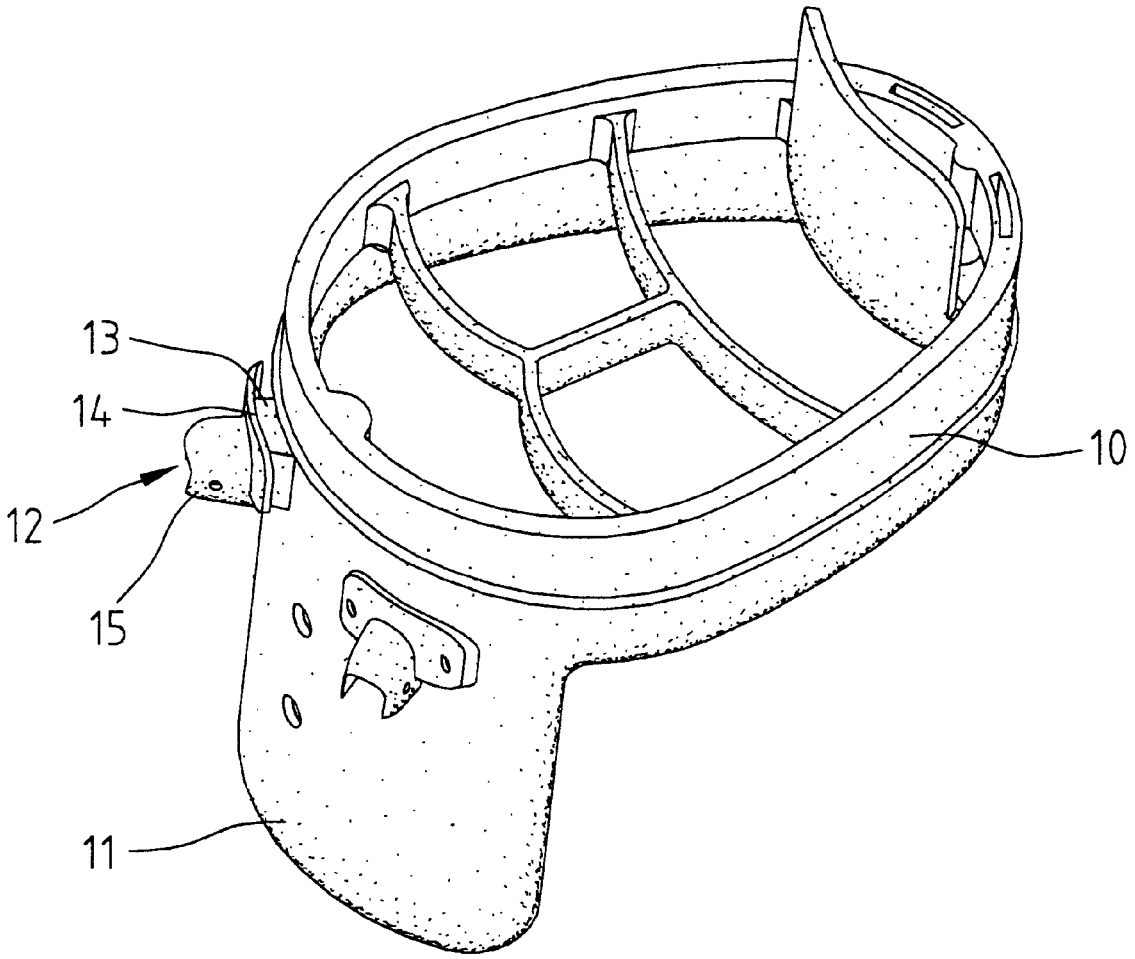
FIG. 2 is a perspective view of a first embodiment of a head frame for a golf bag in accordance with the present invention.
Figure 3:
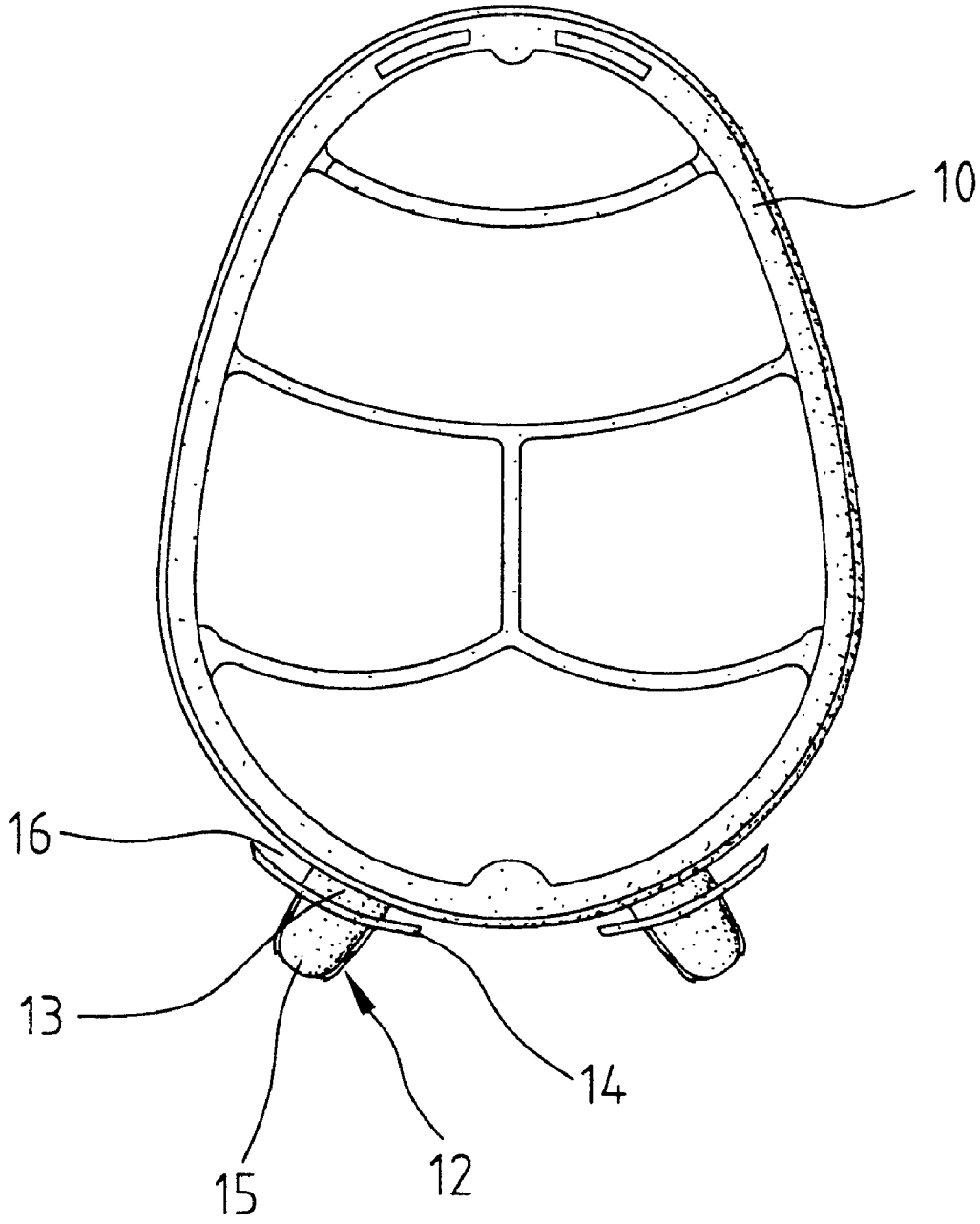
FIG. 3 is a top view of the head frame in FIG. 2.
Figure 4:
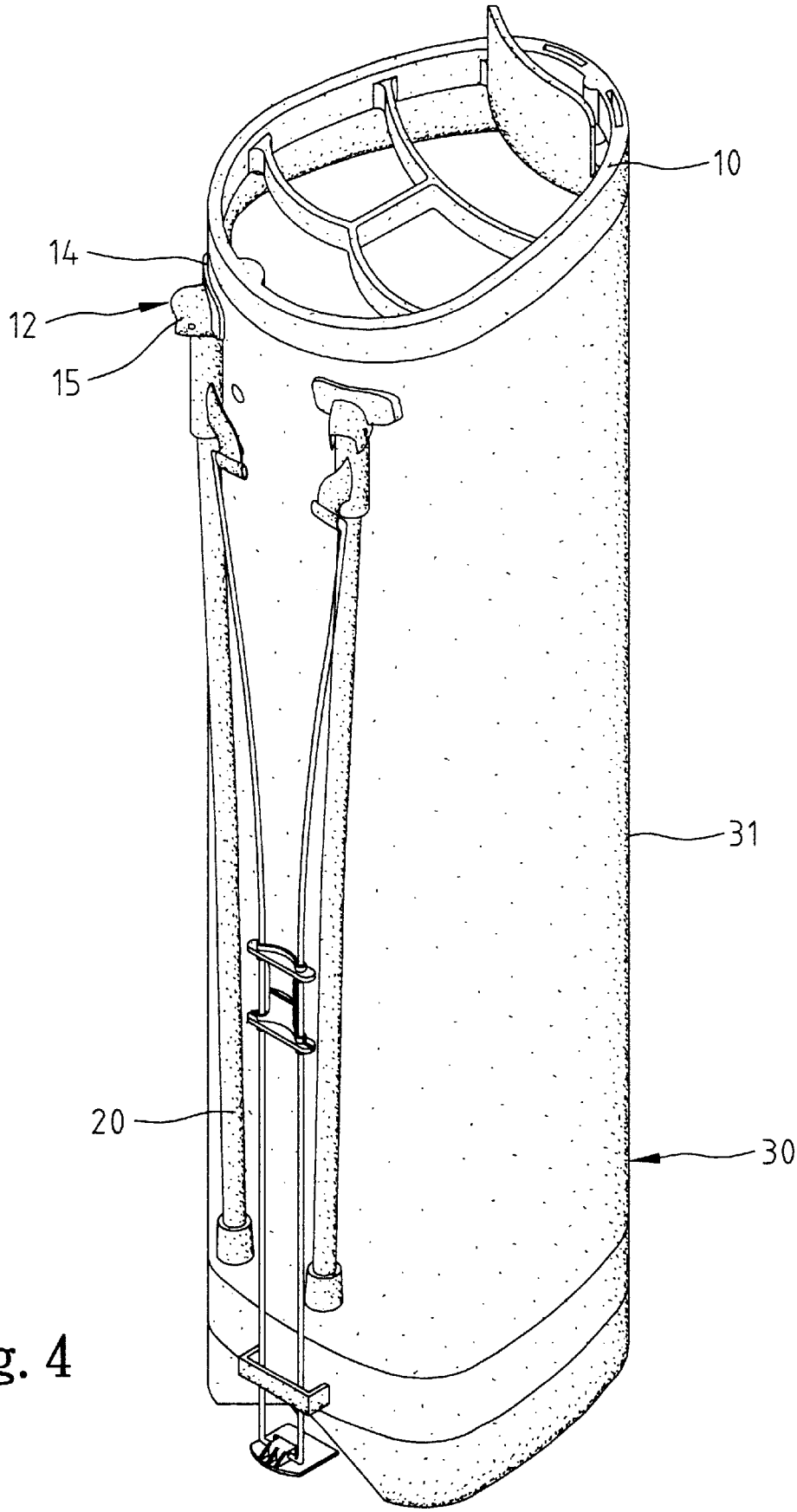
FIG. 4 is a perspective view of a golf bag equipped with the head frame in FIG. 2.

Referring to FIGS. 2 through 7 and initially to FIGS. 2 and 3, a head frame 10 in accordance with the present invention includes a board 11 that extends downward from a rear of the head frame 10. The board 11 is integrally formed with the head frame 10 by injection molding. Two spaced pivotal seats 12 are integrally formed on the board 11. Each pivotal seat 12 includes a block 13 integrally formed on the board 11, a stop 14 formed on the block 13, and a pivotal section 15 formed on the stop 14. An upper end (not labeled) of an associated supporting rod 20 is pivotally connected to the pivotal section 15 (FIG. 4). Provision of the block 13 defines a space 16 (FIG. 3) between the stop 14 and the board 11, which will be described later.

Since the pivotal seats 12 and the board 11 are integrally formed with the head frame 10, precise positioning of the pivotal seats 12 can be obtained by injection molding. This assures correct positioning of the supporting rods 20, and reliable supporting function is obtained.

Referring to FIG. 4, since the pivotal seats 12 are integrally formed on the board 11, a bag 31 made of cloth can be directly mounted around the head frame 10 as well as the integrally formed board 11. The bag 31 includes two holes (not shown) that allow passage of the pivotal seats 12 during mounting of the bag 31. A thickness of the bag 31 fills the space 16 between the stop 14 and the board 11. After mounting of the bag 31 for forming a golf bag 30, positioning of the pivotal seats 12 is not required. The assembly procedure is thus simplified.

Figure 5:
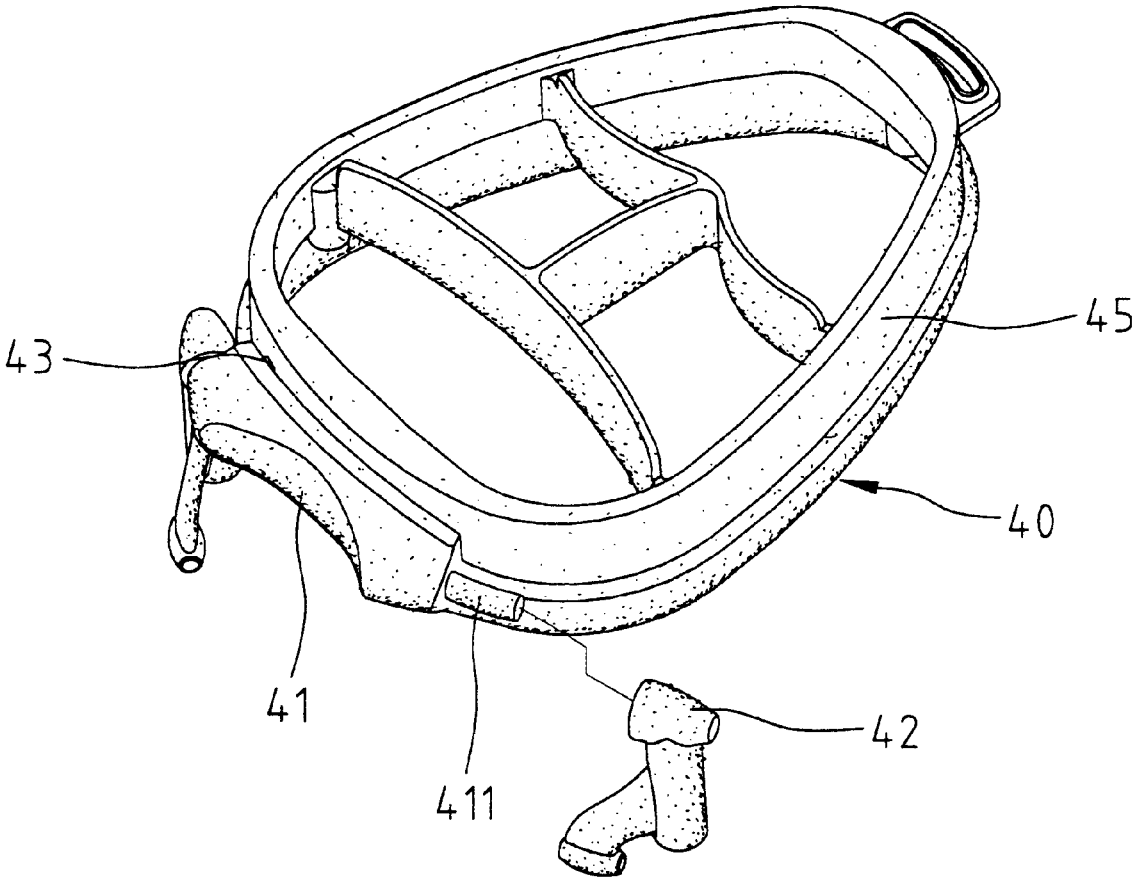
FIG. 5 is a perspective view of a second embodiment of the head frame in accordance with the present invention.
Figure 6:
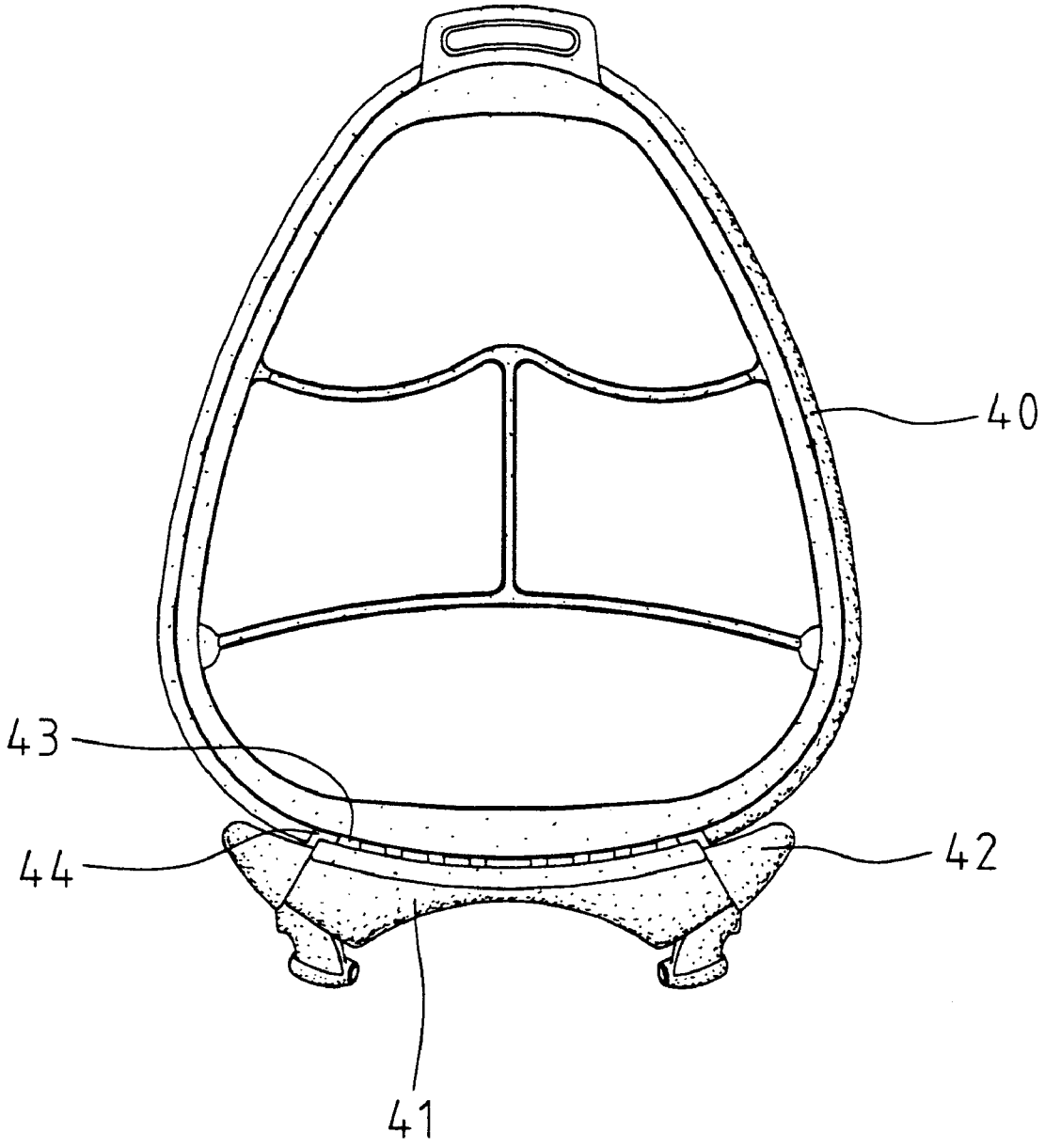
FIG. 6 is a top view of the head frame in FIG. 5.
Figure 7:
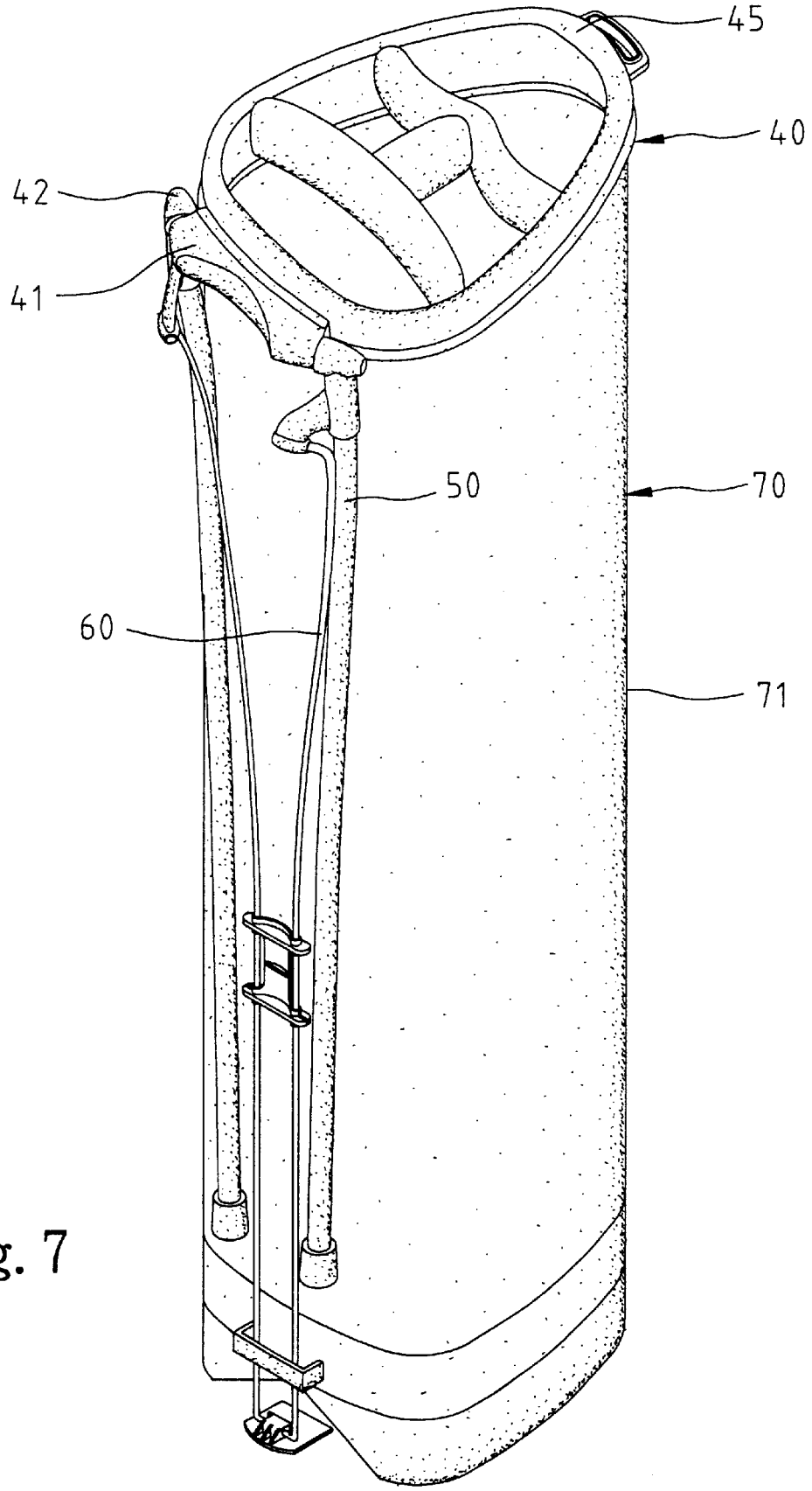
FIG. 7 is a perspective view of a golf bag equipped with the head frame in FIG. 5.

FIGS. 5 through 7 illustrates a second embodiment of the head frame in accordance with the present invention. As illustrated in FIGS. 5 and 6, a pivotal seat 41 is integrally formed with a side of the head frame 40 by injection molding. The pivotal seat 41 includes a peg 411 on each of two sides thereof. A pivotal member 42 is pivotally mounted to each peg 411, and an upper end of an associated supporting rod 50 is securely attached to the pivotal member 42 to move therewith. A connecting strip 60 is mounted beside each supporting rod 50. Each connecting strip 60 has an upper end connected to an associated pivotal member 42 (FIG. 7). which is conventional and therefore not described in detail. As illustrated in FIG. 6, a plurality of blocks 43 are formed between the head frame 40 and the pivotal seat 41, thereby defining a space 44 between the head frame 40 and the pivotal seat 41.

Since the pivotal seat 41 is integrally formed with the head frame 40, precise positioning of the pegs 411 on the pivotal seat 41 can be obtained by injection molding. This assures correct positioning of the supporting rods 50, and reliable supporting function is obtained.

Velour 45 is provided to cover the head frame 40 that is made of plastic material, which becomes rigid after formation. The velour 45 may prevent damage to the golf club heads received in the bag 71 of the golf bag 70. During assembly, the velour 45 is cut to form an opening (not shown) to allow the pivotal seat 41 to pass therethrough. The velour 45 is mounted around the blocks 43 and the width of the velour 45 is sized such that a portion of the velour 45 is fitted in the space 44 between the pivotal seat 41 and the head frame 40. Thereafter, the bag 71 is mounted on the main frame for the golf bag 70. The assembly procedure is simplified, as positioning of the pivotal seats 12 is not required.

Although the invention has been explained in relation to its preferred embodiment, it is to be understood that many other possible modifications and variations can be made without departing from the spirit and scope of the invention as hereinafter claimed.

What is claimed is:

1. A head frame for a golf bag, comprising at least one pivotal seat integrally formed thereon, said at least one pivotal seat being adapted to be in pivotal connection with an upper end of a supporting rod, wherein said at least one pivotal seat includes a peg on each of two sides of and integrally formed as one piece with said at least one pivotal seat.

2. The head frame as claimed in claim 1, wherein said head frame and said at least one pivotal seat have at least one block integrally formed between the head frame and an attachment surface of said at least one pivotal seat, with said at least one block being of a smaller size than the attachment surface, said at least one block defining a space between the head frame and the attachment surface of said at least one pivotal seat and outward of said at least one block for receiving a thickness of a golf bag.

3. A golf bag comprising:

a bag;

a head frame mounted to an end of the bag, the head frame comprising a pivotal seat integrally formed thereon, the pivotal seat including a peg formed on each of two sides of and integrally formed as one piece with the pivotal seat; and two supporting rods each having an upper end pivotally connected to an associated said peg.

4. The head frame as claimed in claim 3, wherein said head frame and the pivotal seat have at least one block integrally formed between the head frame and an attachment surface of the pivotal seat, with said at least one block being of a size smaller than the attachment surface, said at least one block defining a space between the head frame and the attachment surface of the pivotal seat and outward of said at least one block for receiving a thickness of a bag.

5. A golf bag comprising:

a bag;

a head frame mounted to an end of the bag;

at least one block;

at least one pivotal seat having an attachment surface, with said at least one block being of a smaller size than the attachment surface, with the block and the pivotal seat being integrally formed as a single molded component on the head frame with the block located intermediate the attachment surface and the head frame, with said at least one block defining a space between the head frame and the attachment surface of said at least one pivotal seat and outward of said at least one block for receiving a thickness of a golf bag; and two supporting rods each having an upper end pivotally connected to said at least one pivotal seat about a pivot axis, with the space located intermediate the pivot axis and the head frame.

6. The golf bag as claimed in claim 5, further comprising: a stop integrally formed on the block, with the block intermediate the stop and the head frame, with the pivotal seat including a pivotal section integrally formed on the stop, with the stop intermediate the pivotal section and the block, with the stop forming and defining the attachment surface, with the space being between the head frame and the stop for receiving the golf bag.

7. The golf bag as claimed in claim 5, with two pivotal seats being integrally formed on the head frame.

8. The golf bag as claimed in claim 5, further comprising: a velour for covering the head frame, with the velour mounted around the block and being fitted in the space between the pivotal seat and the head frame.

9. The golf bag as claimed in claim 5, with the upper end of each of said two supporting rods being pivotally connected to a peg formed on said at least one pivotal seat.

10. The golf bag as claimed in claim 9, further comprising: a velour for covering the head frame, with the velour mounted around the block and being fitted in the space between the pivotal seat and the head frame.

11. The golf bag as claimed in claim 5, wherein said at least one pivotal seat includes a peg on each of two sides thereof.

12. The golf bag as claimed in claim 11, further comprising: a velour for covering the head frame, with the velour mounted around the block and being fitted in the space between the pivotal seat, and the head frame.

13. The golf bag as claimed in claim 5, with the head frame including a board integrally formed thereon and extended downward therefrom, with the bag located outward of and extending over the board.

14. The golf bag as claimed in claim 13, with the block being integrally formed on the board of the head frame.

15. The golf bag as claimed in claim 14, with two pivotal seats being integrally formed on the head frame.

16. A head frame comprising:

a ring which is adapted to mount a golf bag therearound, with the ring adapted to receive golf clubs, with the ring including a rear;

a board extending downward from the rear of the ring, with the board integrally formed with the ring by injection molding as a single component; and at least one pivotal seat adapted to be in pivotal connection with an upper end of a supporting rod, with the at least one pivotal seat integrally formed with the board by injection molding as part of the single component, with the at least one pivotal seat being spaced from the ring allowing the golf bag to extend beyond the at least one pivotal seat.

17. The head frame as claimed in claim 16, further comprising: a second pivotal seat integrally formed with the board spaced from the at least one pivotal seat and at equal spacing from the ring as the at least one pivotal seat.

18. The head frame as claimed in claim 16, wherein said at least one pivotal seat includes a block integrally formed on the board, a stop integrally formed on the block, and a pivotal section integrally formed on the stop, with the block defining a space between the head frame and the stop and adapted to receive the golf bag.

19. The head frame as claimed in claim 18, further comprising: a second pivotal seat integrally formed with the board spaced from the at least one pivotal seat and at equal spacing from the ring as the at least one pivotal seat.

* * * * *